US006165085A

United States Patent [19]

Lubin

[11] Patent Number: 6,165,085

[45] Date of Patent: Dec. 26, 2000

[54] SOCCER GOAL

[76] Inventor: Ronnie L. Lubin, 1515 Holly Hill, Germantown, Tenn. 38138

[21] Appl. No.: 09/342,798

[22] Filed: Jun. 29, 1999

[51] Int. Cl.[7] ..... A63B 63/00

[52] U.S. Cl. ..... 473/478; 473/435; 273/400

[58] Field of Search ..... 473/478, 477, 473/476, FOR 128; 273/396, 400

[56] References Cited

U.S. PATENT DOCUMENTS

| | | | |
|---|---|---|---|
| 2,077,343 | 4/1937 | Oakes et al. | 473/478 |
| 5,308,083 | 5/1994 | Grunfeld et al. . | |
| 5,531,449 | 7/1996 | Denton . | |
| 5,549,304 | 8/1996 | Davis . | |
| 5,556,104 | 9/1996 | Guillen . | |
| 5,562,288 | 10/1996 | Erkebaev . | |
| 5,655,774 | 8/1997 | Cox . | |
| 5,830,089 | 11/1998 | Halter et al. | 473/478 |

*Primary Examiner*—Jeanette Chapman
*Assistant Examiner*—Mitra Aryanpour
*Attorney, Agent, or Firm*—Walker, McKenzie & Walker, P.C.

[57] ABSTRACT

An improved soccer goal of the type including a net and a frame for supporting the net. The frame includes a first vertical front post, a second vertical front post, a front bottom cross bar, a front top cross bar, a first horizontal side bar, a second horizontal side bar, a rear bottom cross bar, a first diagonal strut, and a second diagonal strut. The improvement includes an intermediate cross bar having a first end for attachment to the first diagonal strut and a second end for attachment to the second diagonal strut with the net attached to the intermediate cross bar to create a first back stop portion extending between the intermediate cross bar and the front top cross bar and a second back stop portion extending diagonally between the intermediate cross bar and the front bottom cross bar.

2 Claims, 2 Drawing Sheets

11
15
35
37
39
91
89
21
43
49
27
41
47
75
87
85
77
79
23
45
51
63
67
65
69
59
17
19
25
57
53
55
31
29
33
61

11
15
35
37
39
93
21
27
23
41
81
95
13
85
45
91
83
89
67
65
57
17
19
25
53
55
31
29
33

SOCCER GOAL

CROSS-REFERENCE TO RELATED APPLICATIONS

Not Applicable.

STATEMENT RE FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates, in general, to soccer goals and, more specifically, to an improved soccer goal which allows both ball targeting and retrieval.

2. Information Disclosure Statement

A preliminary patentability search conducted in class 473, subclass 478, and class 273, subclasses 396 and 400, produced the following patents which appear to be relevant to the present invention:

Grunfeld et al., U.S. Pat. No. 5,308,083, issued May 3, 1994, discloses a portable soccer goal including a frame formed by a pair of vertical posts and a long horizontal tube joining the upper ends of the vertical posts; a net having a sleeve that positively joins the net to the frame over the entire horizontal length of the frame; and a resilient mainstay cord threaded into the net near the periphery. The frame is secured to the ground by a pair of base supports and the net and mainstay cord are secured by hooks at the base support. Pivotable supports further support the vertical posts. When the struts are spread outwards, the tension in the net is increased so as to be sufficient to rebound a ball struck into the net.

Denton, U.S. Pat. No. 5,531,449, issued Jul. 2, 1996, discloses a portable stoop ball striker comprising a generally A-shaped framework having a rearward tilted front panel and a forward tilted rear panel. The framework can sit upon a horizontal playing field. The front panel has a striking face divided into a flat slopped upper surface, a horizontal edge and a curved lower surface. A person can throw a ball against the striking face to rebound the ball at different angles and speeds into the playing field.

Davis, U.S. Pat. No. 5,549,304, issued Aug. 27, 1996, discloses a soccer ball control apparatus including a frame having a first rectangular frame, a second rectangular frame joined at right angles to one edge of the first rectangular frame, and a net stretched tightly across the first rectangular frame and stretched loosely across three edges of the second rectangular frame. When the apparatus is positioned with the first rectangular frame perpendicular to the ground, the tightly stretched net rebounds a ball kicked thereinto substantially straight back (see FIG. 1 of the Davis patent). When the apparatus is positioned with the first rectangular frame at an angle to the ground, the tightly stretched net rebounds a ball kicked thereinto substantially upwards (see FIG. 3 of the Davis patent). When the apparatus is positioned with the first rectangular frame on the ground, the loosely stretched net acts like a typical soccer goal (see FIG. 2 of the Davis patent).

Guillen, U.S. Pat. No. 5,556,104, issued Sep. 17, 1996, discloses a soccer practice device including a frame, a net and a rigid board. The device can be positioned with the board positioned perpendicular to the ground to return a soccer ball kicked against the rigid board on a substantially straight trajectory (see FIG. 7 of the Guillen patent), with the rigid board positioned at an angle to the perpendicular plane to deflect a soccer ball kicked against the rigid board upwardly (see FIG. 8 of the Guillen patent), or with the rigid board on the ground to act substantially as a typical soccer goal (see FIG. 9 of the Guillen patent).

Erkebaev, U.S. Pat. No. 5,562,288, issued Oct. 8, 1996, discloses a portable sports goal comprising a net, multisectional resilient poles, a connector, a support and retainers. Corners of the net are removably connected to the outer ends of the resilient poles. The connector joins the resilient poles together to exert stretching force along diagonals of the net. The support and retainers secure the goal to a playing field in a generally upright position.

Cox, U.S. Pat. No. 5,655,774, issued Aug. 12, 1997, discloses a folding, portable sports goal comprised of hinged crossbar and bottom rail assemblies such that when the frame members are detached at two points, the structure of the goal can be slid into an alternate embodiment and folded into a thin, planar configuration that is portable.

Nothing in the known prior art discloses or suggests the present invention. More specifically, nothing in the known prior art discloses or suggests a soccer goal including a net; a frame for supporting the net, the frame including a first vertical front post having a lower end and an upper end, a second vertical front post having a lower end and an upper end a front bottom cross bar having a first end for attachment generally to the lower end of the first vertical front post and a second end for attachment generally to the lower end of the second vertical front post, a front top cross bar having a first end for attachment generally to the upper end of the first vertical front post and a second end for attachment generally to the upper end of the second vertical front post, a first diagonal strut having an upper end for attachment generally to the first end of the front top cross bar and a lower end, and a second diagonal strut having an upper end for attachment generally to the second end of the front top cross bar and a lower end; and an intermediate cross bar having a first end for attachment to the first diagonal strut and a second end for attachment to the second diagonal strut with the net attached to the intermediate cross bar to create a first back stop portion extending between the intermediate cross bar and the front top cross bar and a second back stop portion extending diagonally between the intermediate cross bar and the front bottom cross bar.

BRIEF SUMMARY OF THE INVENTION

The present invention provides an improved soccer goal which allows soccer ball targeting and retrieval.

The improved soccer goal of the present invention includes a net; a frame for supporting the net, the frame including a first vertical front post having a lower end and an upper end, a second vertical front post having a lower end and an upper end a front bottom cross bar having a first end for attachment generally to the lower end of the first vertical front post and a second end for attachment generally to the lower end of the second vertical front post, a front top cross bar having a first end for attachment generally to the upper end of the first vertical front post and a second end for attachment generally to the upper end of the second vertical front post, a first diagonal strut having an upper end for attachment generally to the first end of the front top cross bar and a lower end, and a second diagonal strut having an upper end for attachment generally to the second end of the front top cross bar and a lower end; and an intermediate cross bar having a first end for attachment to the first diagonal strut and a second end for attachment to the second diagonal strut with the net attached to the intermediate cross bar to create a first back stop portion extending between the intermediate cross bar and the front top cross bar and a second back stop portion extending diagonally between the intermediate cross bar and the front bottom cross bar.

DETAILED DESCRIPTION OF THE INVENTION

Figure 1:
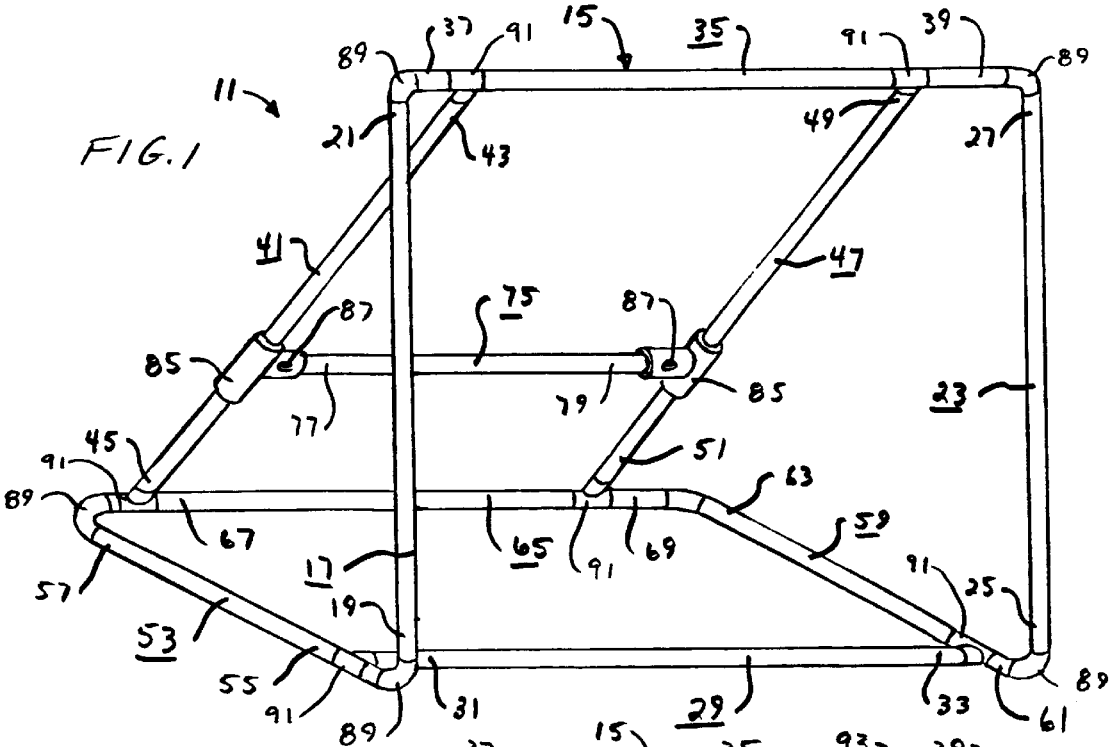
FIG. 1 is a perspective view of the frame and intermediate cross bar of the improved soccer goal of the present invention.

A preferred embodiment of the improved soccer goal of the present invention is shown in FIGS. 1–5, and identified by the numeral 11. The improved soccer goal 11 is of the type including a net 13 and a frame 15 for supporting the net 13.

The frame 15 includes, in general, first vertical front post 17 having a lower end 19 and an upper end 21, a second vertical front post 23 having a lower end 25 and an upper end 27, a front bottom cross bar 29 having a first end 31 for attachment generally to the lower end 19 of the first vertical front post 17 and a second end 33 for attachment generally to the lower end 25 of the second vertical front post 23, a front top cross bar 35 having a first end 37 for attachment generally to the upper end 21 of the first vertical front post 17 and a second end 39 for attachment generally to the upper end 27 of the second vertical front post 23, a first diagonal strut 41 having an upper end 43 for attachment generally to the first end 37 of the front top cross bar 35 and a lower end 45, and a second diagonal strut 47 having an upper end 49 for attachment generally to the second end 39 of the front top cross bar 35 and a lower end 51. Preferably, the frame 15 includes a first horizontal side bar 53 having a front end 55 for attachment generally to the lower end 19 of the first vertical front post 17 and a rear end 57, a second horizontal side bar 59 having a front end 61 for attachment generally to the lower end 25 of the second vertical front post 23 and a rear end 63, and a rear bottom cross bar 65 having a first end 67 for attachment generally to the rear end 57 of the first horizontal side bar 53 and a second end 69 for attachment generally to the rear end 63 of the second horizontal side bar 59. The lower end 45 of the first diagonal strut 41 is preferably for attachment generally to the first end 67 of the rear bottom cross bar 65. The lower end 51 of the second diagonal strut 47 is preferably for attachment generally to the second end 69 of the rear bottom cross bar 65.

The improvement of the present invention comprises an intermediate cross bar 75 having a first end 77 for attachment to the first diagonal strut 41 and a second end 79 for attachment to the second diagonal strut 47 with the net 13 attached to the intermediate cross bar 75 to create a first back stop portion 81 extending between the intermediate cross bar 75 and the front top cross bar 35 and a second back stop portion 83 extending diagonally between the intermediate cross bar 75 and the front bottom cross bar 29. The intermediate cross bar 75 is preferably adjustably attached to the first and second diagonal struts 41, 47 for allowing the tension of the first and second back stop portions 81, 83 of the net 13 to be varied. For example, a two-part tee 85 may be used to attach each end 77, 79 of the intermediate cross bar 75 to the respective strut 41, 47 and a nut-and-bolt assembly 87 may be used to clamp the tee 85 to the intermediate cross bar 75 and respective strut 41, 47. The nut-and-bolt assembly 87 can merely be loosened to allow the intermediate cross bar 75 to be easily slid toward the rear bottom cross bar 65 or the front top cross bar 35 to increase or decrease the tension of the first and second back stop portions 81, 83 of the net 13.

The frame 15 and intermediate cross bar 75 may be constructed in various specific shapes and sizes, and in various manners and out of various materials as will now be apparent to those skilled in the art. Thus, for example, the posts 17, 23, cross bars 29, 35, 65, struts 41, 47, side bars 53, 59 may all be constructed out of substantially rigid pipe or tubes rigidly joined to one another by glue or welds, etc., to form an integral, one-piece unit, etc. Preferably, however, the various posts 17, 23, cross bars 29, 35, 65, struts 41, 47, and side bars 53, 59 of the frame 15 are constructed out of individual lengths of substantially rigid pipe or tubes (e.g., 1⅜ inch diameter aluminum tubing) with the ends joined to one another by elbows 89 and tees 91, etc., as will now be apparent to those skilled in the art. Each elbow 89 and tee 91 may be constructed to two halves jointed together by a nut-and-bolt assembly or the like, as hereinabove described relative to the tee 85 and nut-and-bolt assembly 87, to allow the frame 15 to be easily assembled and disassembled, etc. The elbows 71 and tees 73 clamp the various parts together and are preferably sized so that the bolts do not pass through any post 17, 23, cross bar 29, 35, 65, strut 41, 47, or side bar 53, 59. Certain of the bolts may be eye bolts to allow the net 13 to be easily tied thereto as will hereinafter become apparent. The intermediate cross bar 75 is also preferably constructed out of an individual length of substantially rigid pipe or tubes (e.g., 1⅜ inch diameter aluminum tubing) with the ends movably joined to the respective first and second diagonal struts 41, 47 by way of the tees 85, etc., as will now be apparent to those skilled in the art.

The net 13 may be a substantially standard soccer goal net made of nylon rope or the like with a substantially vee shape without a front or back, just up and down, for be secured to the first and second vertical front posts 17, 23, and the front bottom and front trop cross bars 29, 35 of the frame 15, and to the intermediate cross bar 75 with strings, Velcro® straps, tie ropes, etc. A single elongated first tie rope 93 may be used for looping around the first and second vertical front posts 17, 23, and the front bottom and front top cross bars 29, 35 of the frame 15 and through every other square of the mouth of the net 13 to thereby secure the mouth of the net 13 to the mouth of the frame 15. A separate elongated second tie rope 95 may be used for looping around the intermediate cross bar 75 and through every square of the vee end of the net 13 to thereby secure the vee end of the net 13 to the intermediate cross bar 75. Extra pieces of string, Velcro® straps and the like may be used to position and hold the net 13 as the tie ropes 93, 95 are secured in place, etc.

As thus constructed, the present invention provides a single soccer goal that permits an interactive soccer work out, allowing the player to work on both soccer ball targeting and retrieval while combining activities such as heading or tapping with shooting and other foot skills.

Although the present invention has been described and illustrated with respect to a preferred embodiment and a preferred use therefor, it is not to be so limited since modifications and changes can be made therein which are within the full intended scope of the invention.

What is claimed is:

1. An improved soccer goal of the type including a net and a frame for supporting said net, said frame including:

a first vertical front post having a lower end and an upper end, a second vertical front post having a lower end and an upper end, a front bottom cross bar having a first end attached to said lower end of said first vertical front post and a second end attached to said lower end of said second vertical front post, a front top cross bar having a first end attached to said upper end of said first vertical front post and a second end attached to said upper end of said second vertical front post, a first diagonal strut having an upper end attached to said first end of said front top cross bar and a lower end, and a second diagonal strut having an upper end attached to said second end of said front top cross bar and a lower end, wherein the improvement comprises an intermediate cross bar adjustably attached to said first and second diagonal struts for movement between said upper and lower ends of said first and second diagonal struts, said intermediate cross bar having a first end adjustably attached to said first diagonal strut and a second end adjustably attached to said second diagonal strut with said net attached to said intermediate cross bar to create a first back stop portion extending between said intermediate cross bar and said front top cross bar and a second back stop portion extending diagonally between said intermediate cross bar and said front bottom cross bar so that movement of said intermediate cross bar between said upper and lower ends of said first and second diagonal struts will cause the tension of said first and second back stop portions of said net to be varied.

2. An improved soccer goal of the type including a net and a frame for supporting said net, said frame including:

a first vertical front post having a lower end and an upper end, a second vertical front post having a lower end and an upper end, a front bottom cross bar having a first end attached to said lower end of said first vertical front post and a second end attached to said lower end of said second vertical front post, a front top cross bar having a first end attached to said upper end of said first vertical front post and a second end attached to said upper end of said second vertical front post, a first horizontal side bar having a front end attached to said lower end of said first vertical front post and a rear end, a second horizontal side bar having a front end attached to said lower end of said second vertical front post and a rear end, a rear bottom cross bar having a first end attached to said rear end of said first horizontal side bar and a second end attached to said rear end of said second horizontal side bar, a first diagonal strut having a lower end attached to said first end of said rear bottom cross bar and an upper end attached to said first end of said front top cross bar, and a second diagonal strut having a lower end attached to said second end of said rear bottom cross bar and an upper end attached to said second end of said front top cross bar, wherein the improvement comprises an adjustable intermediate cross bar slidably attached to said first and second diagonal struts for movement between said upper and lower ends of said first and second diagonal struts, said adjustable intermediate cross bar having a first end slidably attached to said first diagonal strut and a second end slidably attached to said second diagonal strut with said net attached to said intermediate cross bar to create a first back stop portion extending between said intermediate cross bar and said front top cross bar and a second back stop portion extending diagonally between said intermediate cross bar and said front bottom cross bar; movement of said intermediate cross bar on said first and second diagonal struts between said upper and lower ends thereof causing the tension of said first and second back stop portions of said net to be varied.

* * * * *

UNITED STATES PATENT AND TRADEMARK OFFICE

CERTIFICATE OF CORRECTION

PATENT NO. : 6,165,085
DATED : December 26, 2000
INVENTOR(S) : Ronnie L. Lubin

Figure 2:
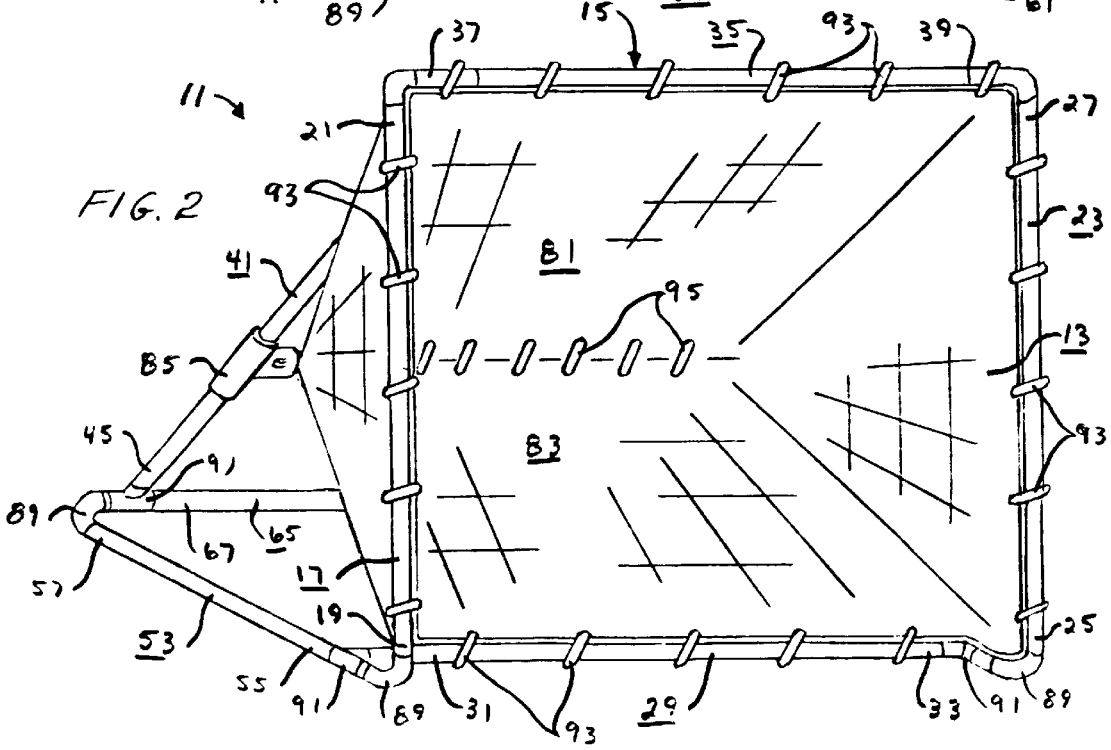
FIG. 2 is a somewhat diagrammatic perspective view similar to FIG. 1 but showing the net of the improved soccer goal of the present invention attached to the frame and intermediate cross bar thereof.
Figure 3:
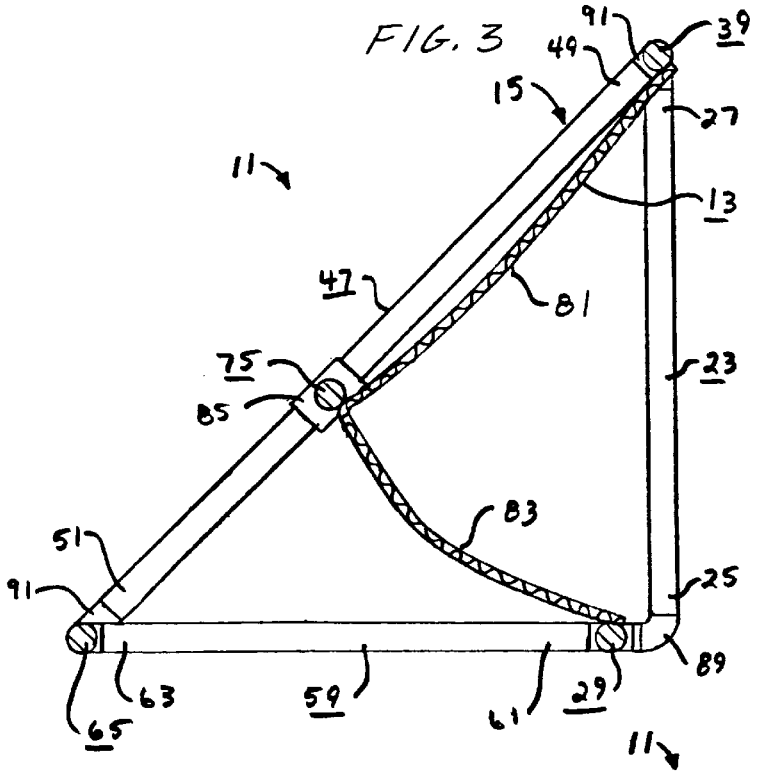
FIG. 3 is a sectional view substantially as taken on line 3—3 of FIG. 2, showing the intermediate cross bar in a first position.
Figure 4:
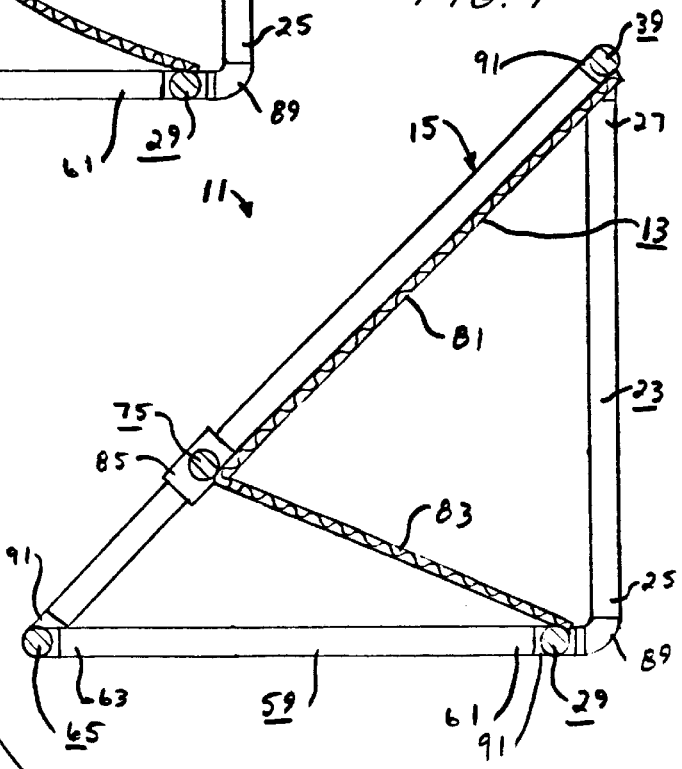
FIG. 4 is a sectional view similar to FIG. 3 but showing the intermediate cross bar in a second position.
Figure 5:
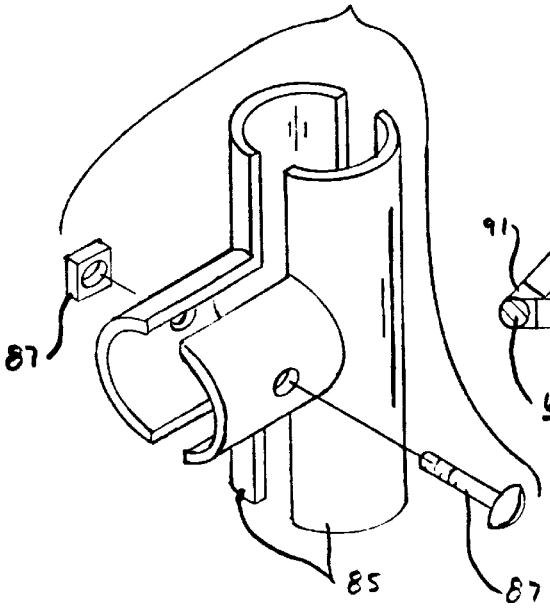
FIG. 5 is an exploded perspective view of a tee and nut-and-bolt assembly as used to movably attach the intermediate cross bar to the frame of the improved soccer goal of the present invention.
Figure 1:
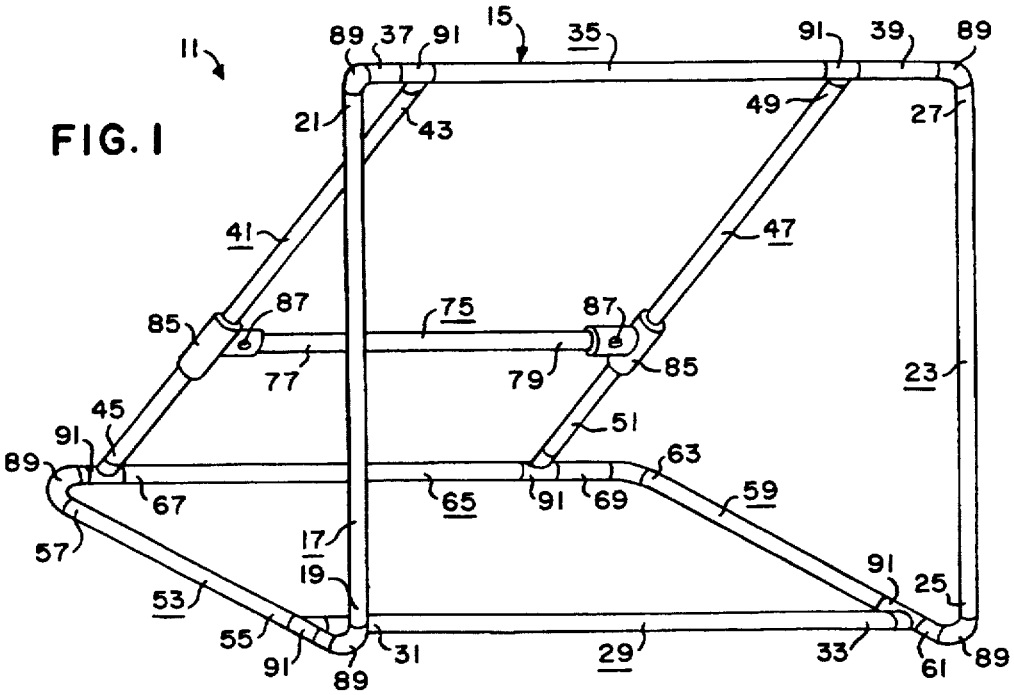
Figure 2:
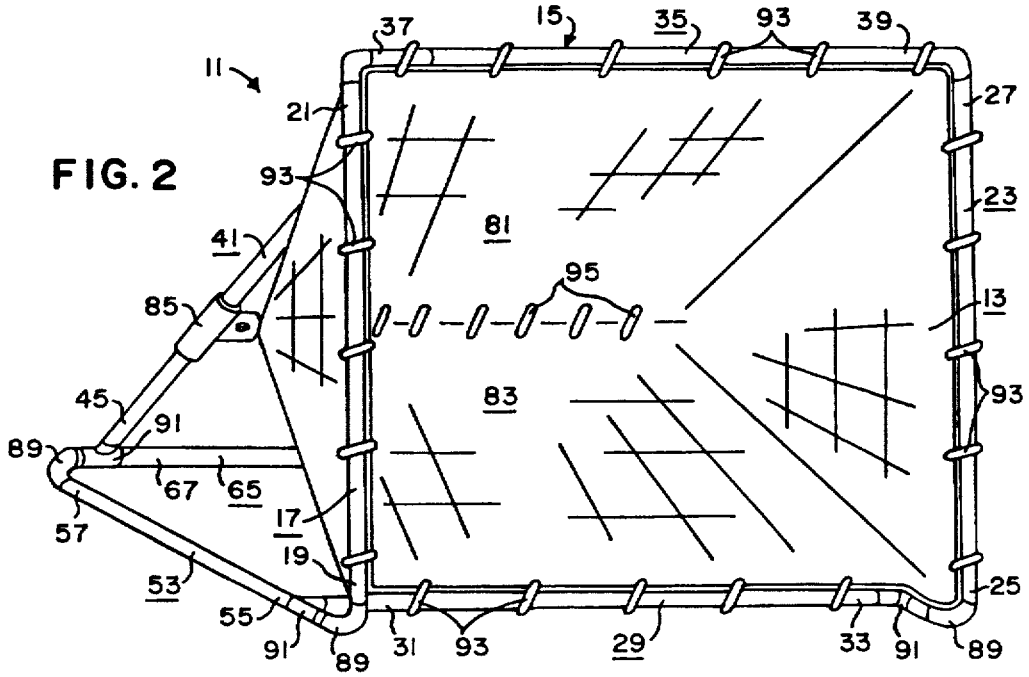
Figure 3:
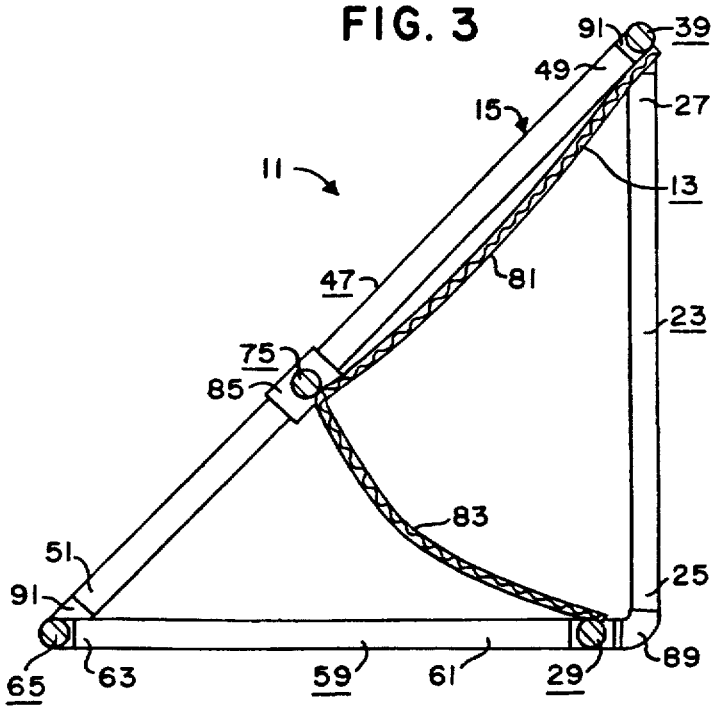
Figure 4:
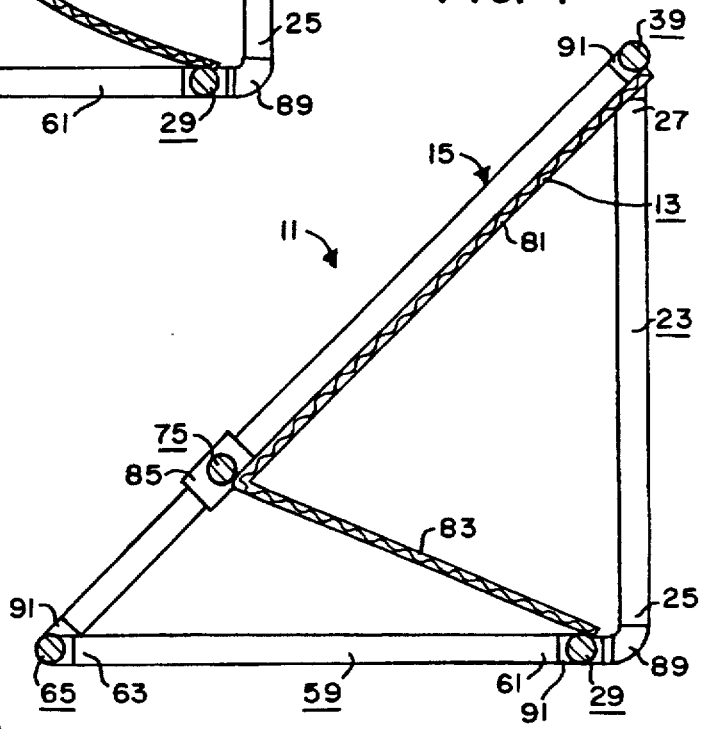
Figure 5:
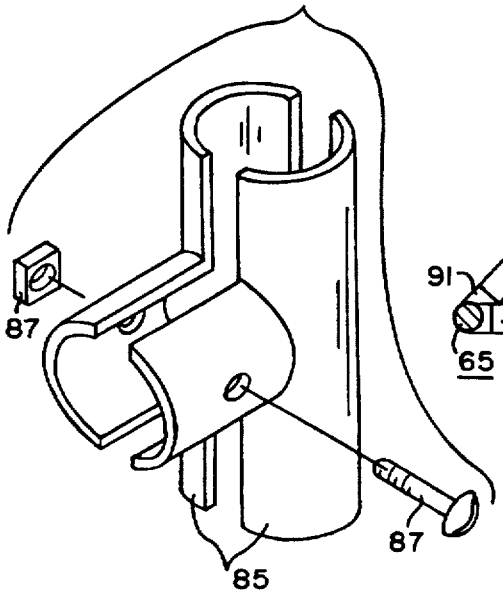

It is certified that error appears in the above-identified patent and that said Letters Patent is hereby corrected as shown below:

Title page,
Delete the sample figure if the invention and replace said sample figure with Fig. 2 of the attached formal drawings.

Drawings,
Replace sheets 1 and 2 with the the attached sheets 1 and 2 (Figs. 1-5) of the attached formal drawings.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*